US008125393B2

(12) United States Patent
Dreina et al.

(10) Patent No.: US 8,125,393 B2
(45) Date of Patent: Feb. 28, 2012

(54) RECONFIGURABLE ELECTROMAGNETIC ANTENNA

(75) Inventors: Emmanuel Dreina, Meylan (FR); Michel Pons, Meylan (FR); Marc Berenguer, Revel (FR)

(73) Assignee: France Telecom, Paris (FR)

( * ) Notice: Subject to any disclaimer, the term of this patent is extended or adjusted under 35 U.S.C. 154(b) by 453 days.

(21) Appl. No.: 12/482,615

(22) Filed: Jun. 11, 2009

(65) Prior Publication Data

US 2009/0322646 A1 Dec. 31, 2009

(30) Foreign Application Priority Data

Jun. 27, 2008 (FR) ..... 08 54343

(51) Int. Cl.
*H01Q 1/38* (2006.01)

(52) U.S. Cl. ..... 343/700 MS; 343/846

(58) Field of Classification Search ..... 343/700 MS, 343/846, 872, 848; 29/600
See application file for complete search history.

(56) References Cited

U.S. PATENT DOCUMENTS 6,191,754 B1 2/2001 Nathanson et al.
(Continued)

*Primary Examiner* — Hoanganh Le
(74) *Attorney, Agent, or Firm* — Drinker Biddle & Reath LLP

(57) ABSTRACT

A reconfigurable electromagnetic antenna which comprises a radiating element consisting of a fluid substance that conducts electricity, the volume of the fluid substance being variable and that also comprises a matrix of electrodes on which the fluid substance is moved by electro-wetting.
The properties of the antenna in frequency, polarization or even in radiation pattern evolve dynamically. The reconfiguration of the antenna in frequency, in polarization or in radiation pattern is continuous and reversible.

12 Claims, 7 Drawing Sheets

U.S. PATENT DOCUMENTS

2004/0252058 A1* 12/2004 Rawnick et al. ..... 343/700 MS
2004/0252069 A1 12/2004 Rawnick et al.
2005/0012677 A1 1/2005 Brown et al.
2005/0057415 A1* 3/2005 Rawnick et al. ..... 343/795
2007/0132656 A1 6/2007 Kim et al.
2007/0216497 A1 9/2007 Krupenkin et al.
2010/0265143 A1* 10/2010 Berenguer et al. ..... 343/702

* cited by examiner

RECONFIGURABLE ELECTROMAGNETIC ANTENNA

CROSS-REFERENCE TO RELATED PATENT APPLICATION

This application claims the benefit of French Patent Application No. 08 54343, filed on Jun. 27, 2008, in the French Institute of Industrial Property, the entire contents of which is incorporated herein by reference.

BACKGROUND OF THE INVENTION

The present invention is situated in the field of reconfigurable electromagnetic antennas.

The proliferation of wireless and mobile applications, in a radiofrequency signal propagation environment constrained by multiple interference and signal attenuation phenomena, requires a great adaptation of the terminals with minimum impact on, among other things, the complexity, the size, the weight, the autonomy or even the cost of these terminals.

The development of reconfigurable electromagnetic antennas for these terminals hopes to overcome these constraints.

There are several types of reconfigurable antennas. For example, there are antennas that can be reconfigured in frequency, antennas that can be reconfigured in polarization or even antennas that can be reconfigured in radiation pattern.

An antenna that can be reconfigured in frequency can adapt its radiation frequency and sweep a wide frequency spectrum. Such an antenna makes it possible, among other things, to receive on one and the same terminal several signals each satisfying a different standard.

An antenna that can be reconfigured in polarization can modify its polarization state (horizontal, vertical, circular or even elliptical) to maximise the received or transmitted signal power.

An antenna that can be reconfigured in radiation pattern can modify its radiation pattern to adapt its directivity to a propagation environment in order, for example, to limit the interference phenomena.

In the current state of the art, given in particular the size constraints of the terminals, the reconfiguration of an antenna is not obtained by a mechanical or physical deformation of the antenna or its component elements.

Currently, the reconfiguration of an antenna can be obtained by switching certain conductive elements of which it is composed (radiating element, dielectric, ground plane).

The reconfiguration of an antenna can also be obtained by having impedances connected to certain points of the antenna varied.

These two reconfiguration modes present drawbacks.

In the case where elements of the antenna are switched, a discontinuous variation of the properties (frequency, polarization, radiation pattern) that are to be made to evolve is obtained.

In the case where impedances connected to certain points of the antenna are made to vary, a continuous variation of the frequency or of the radiation pattern is obtained, but it is limited by the variation ranges of the impedances used.

Furthermore, the devices used for the reconfiguration (switches and impedances) present intrinsic losses that affect the effectiveness of the antenna.

The patent application US 2004/0252069 presents a dynamically reconfigurable antenna with characteristics that can vary.

The radiating element of this antenna comprises a conductive fluid contained in a cavity. This antenna also comprises a fluid control system that makes it possible to selectively add or remove fluid to or from the cavity, this causing the size of the radiating element to be varied.

There is therefore a real need of a technique for reconfiguring an electromagnetic antenna that does not present the abovementioned drawbacks of the known reconfiguration techniques.

SUMMARY OF THE INVENTION

Thus, the present invention relates, according to a first aspect, to a reconfigurable electromagnetic antenna which comprises a radiating element consisting of a fluid substance that conducts electricity, the volume of the fluid substance being variable and that also comprises a matrix of electrodes on which the fluid substance moves by electro-wetting.

The invention makes it possible to produce an antenna with a radiating element that can vary in volume.

These variations make it possible to cause the properties of the antenna to evolve dynamically and obtain the desired properties of the antenna in frequency, in polarization or even in radiation pattern. The reconfiguration of the antenna in frequency, in polarization or in radiation pattern is continuous and reversible.

The application of electrical voltage between the electrodes of the electrode matrix makes it possible to drive the movement and the deformation of the fluid substance in contact with the electrode matrix in a continuous manner.

The electro-wetting phenomena also allows for a deformation of the fluid substance in all dimensions.

According to a preferred characteristic, the fluid substance takes the form of at least one drop.

Since the fluid substance is made up of drops, it is easy to have the volume and the form of the fluid substance that makes up the radiating element of the antenna vary.

According to a preferred characteristic, the antenna according to the invention comprises a reservoir containing the fluid substance and capable of releasing or recovering a portion of the fluid substance.

Thanks to the presence of the reservoir, it is very easy to cause the volume of the fluid substance present on the electrode matrix, and consequently the volume, the size and the form of the radiating element of the antenna, to vary.

According to a preferred characteristic, a portion of the fluid substance is moved from the reservoir to the electrode matrix or vice versa by electro-wetting along a channel of electrodes.

The movement by electro-wetting of the fluid substance is continuous and reversible, thus leading to a continuous and reversible deformation of the fluid substance that makes up the radiating element of the antenna. The reconfiguration of the antenna in frequency, in polarization or in radiation pattern is continuous and reversible.

According to a preferred characteristic, the antenna according to the invention also comprises a dielectric which electrically insulates the electrodes of the electrode matrix and the fluid substance.

The presence of the dielectric makes it possible to electrically insulate the electrodes of the electrode matrix and the fluid substance and thus create a potential difference between the electrodes and the fluid substance.

According to a preferred characteristic, the antenna comprises a radiofrequency port in contact with the fluid substance.

The radiofrequency port in contact with the fluid substance that makes up the radiating element of the antenna makes it possible to render the latter active.

According to a preferred characteristic, the radiofrequency port is a differential port.

The use of a differential radiofrequency port makes it possible to produce dipole or loop type antenna structures.

According to a preferred characteristic, the antenna according to the invention comprises a ground plane.

The ground plane makes it possible to produce antenna structures requiring this type of element such as, for example, patch antennas or even PIFA (standing for Planar Inverted FAntenna) type antennas.

According to a preferred characteristic, the antenna according to the invention also comprises at least one short-circuit element linking the ground plane to the fluid substance.

The short-circuit elements make it possible to increase the possible number of antenna configurations.

According to a preferred characteristic, the antenna according to the invention comprises a capsule enclosing the different component elements of the antenna.

The presence of a capsule facilitates the integration of the antenna in any type of device.

The invention also relates to a terminal incorporating an antenna as described previously.

The invention also relates to a method of manufacturing a reconfigurable electromagnetic antenna comprising a radiating element consisting of a fluid substance that conducts electricity, the volume of the fluid substance being variable, which method comprises a step for inserting an electrode matrix on which the fluid substance is moved by electro-wetting.

BRIEF DESCRIPTION OF THE DRAWINGS

Other features and benefits of the invention will become apparent from reading all the preferred embodiments of an antenna according to the invention, described with reference to the appended figures in which.

DETAILED DESCRIPTION

Figure 1:
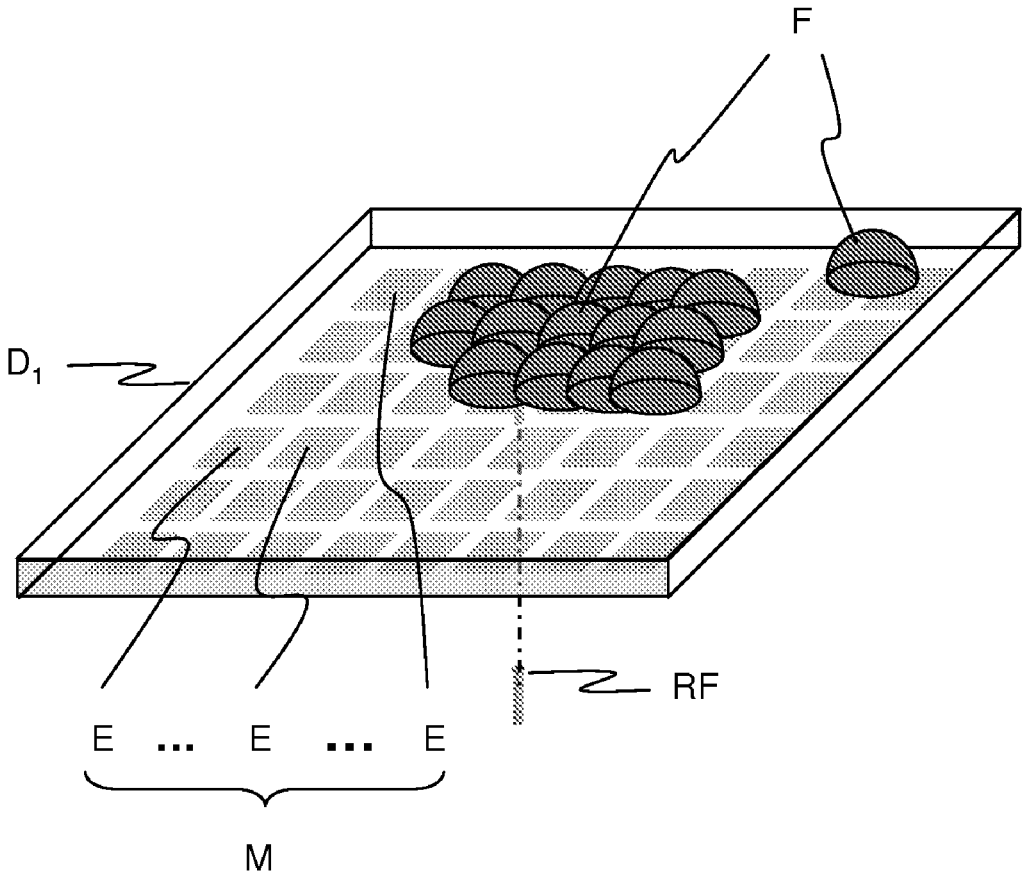
FIG. 1 represents a perspective view of an antenna according to a first embodiment of the invention.

FIG. 1 represents a perspective view of an antenna according to a first embodiment of the invention.

The reconfigurable electromagnetic antenna according to the invention comprises a fluid substance F that conducts electricity.

The fluid substance F takes the form of one or more drops.

The antenna also comprises a radiofrequency port RF making it possible to transmit and receive radiofrequency signals. The RF port is a conductive element that is in contact with at least one drop of the fluid substance.

The portion of the fluid substance F in contact with the radiofrequency port RF corresponds to the active radiating element of the antenna. This portion of the fluid substance F in contact with the radiofrequency port consists of at least one drop of fluid substance F. When the radiating element is made up of a number of drops, all the drops do not need to be in contact with the radiofrequency port RF. It is then enough for one drop to be in contact with the radiofrequency port RF and for the other drops to be in contact with one another and with the drop in contact with the radiofrequency port RF.

One or more drops of the fluid substance F can be insulated and correspond to passive elements of the antenna.

Hereinafter in the description, to illustrate the invention, the fluid substance F corresponding to the radiating element of the antenna is presented in the form of a number of drops. This illustration should not be considered to be limiting on the invention.

As a variant, the fluid substance F is made to conduct electricity by the introduction into this substance of a conductive substance or of particles or fragments of a conductive element. These particles or fragments can be carbon nanotubes or other conductive filaments.

The antenna also comprises a matrix of electrodes M comprising electrodes E.

The electrode matrix M is covered by a first substrate or dielectric $D_1$ which electrically insulates the electrodes E and the drops.

The dielectric $D_1$ can comprise one or more layers of different materials. The layer in contact with the electrodes is made of hydrophobic material presenting a low surface tension such as, for example, PTFE.

The RF port is a conductive element that passes through the electrode matrix M, the dielectric $D_1$ to be in contact with at least one drop of the fluid substance F.

Figure 2:
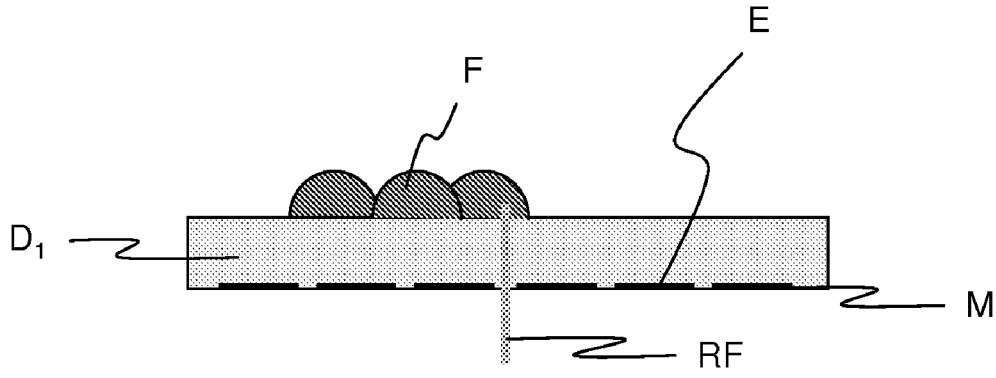
FIG. 2 represents a cross-sectional view along a vertical axis of an antenna according to the embodiment of FIG. 1.

FIG. 2 represents a cross-sectional view along a vertical axis of an antenna according to the first embodiment of the invention.

This figure shows three drops of the fluid substance F. The fluid substance F is separated from the electrode matrix M by the dielectric $D_1$. The RF port passes through the electrode matrix M, the dielectric $D_1$ and is in contact with a drop of the fluid substance F.

Figure 3:
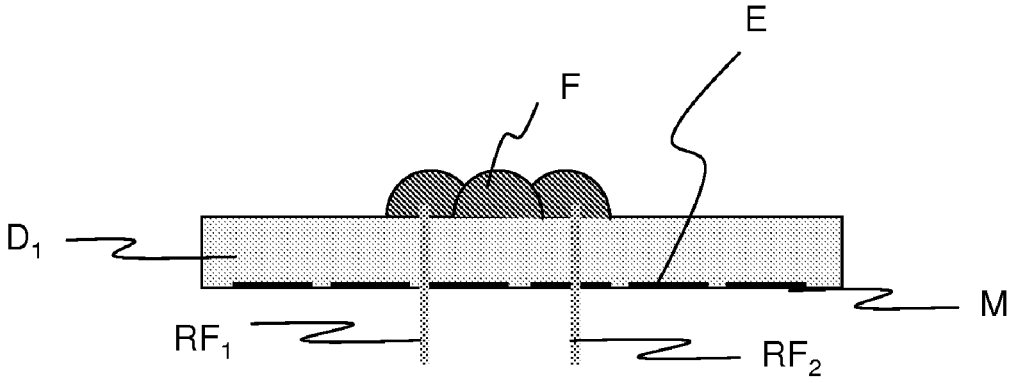
FIG. 3 represents a cross-sectional view along a vertical axis of a variant of an antenna according to the embodiment of the invention of FIG. 1.

FIG. 3 represents a cross-sectional view along a vertical axis of a variant of an antenna according to the first embodiment of the invention.

In this variant, the radiofrequency port is a differential port. The differential radiofrequency port consists of two conductive elements $RF_1$ and $RF_2$ that pass through the electrode matrix M, the dielectric $D_1$ and are each in contact with at least one drop of the fluid substance F.

The radiofrequency signal is then transmitted differentially to the antenna. This variant makes it possible to produce, for example, antennas of dipole or loop type.

The antenna made up according to the first embodiment of the invention described hereinabove functions as follows.

The drops of the fluid substance F are moved over the electrode matrix M by "electro-wetting", that is, by the application of a potential difference (device not represented in FIG. 1) between the electrodes E. A potential difference can also be created between the drops and the electrodes E.

Depending on the movement made, a variable volume of the fluid substance F may be in contact with the radiofrequency port RF. The bringing into contact of a portion or of all of the conductive fluid substance F with the RF port makes it possible for the antenna to receive the radiofrequency signal.

The portion, formed by at least one drop, of the fluid substance F in contact with the radiofrequency port RF corresponds to the radiating active element of the antenna.

Thus, advantageously, an antenna is produced with a radiating active element that can vary in volume and in form.

The surface of the volume of the conductive fluid substance F in contact with the dielectric $D_1$ can vary. The form of this surface in contact with the dielectric $D_1$ can also vary. The contact angle between each of the points of the surface of the volume of the conductive fluid substance F and the dielectric $D_1$ can also vary.

These variations make it possible to cause the properties of the antenna to evolve dynamically and obtain the desired properties of the antenna in frequency, in polarization or even in radiation pattern. The reconfiguration of the antenna in frequency, in polarization or in radiation pattern is continuous and reversible.

Thus, the evolution of the properties of the antenna is obtained by a reorganization of the drops of the fluid substance F with, where appropriate, a modification of the number of drops used to form the radiating active element.

The portion of the fluid substance F which is not in contact with the port RF acts as a passive element and makes it possible to modify the properties of the antenna in particular in frequency and in radiation pattern.

Figure 4:
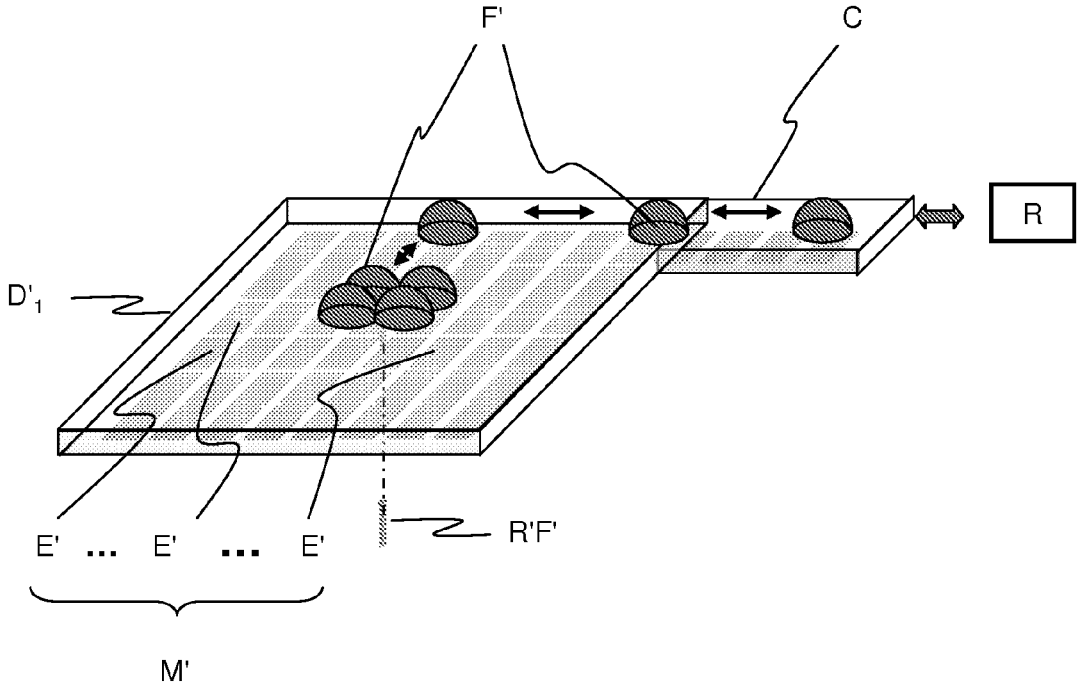
FIG. 4 represents a perspective view of an antenna according to a second embodiment of the invention.

FIG. 4 represents a perspective view of an antenna according to a second embodiment of the invention.

In this second embodiment, the antenna comprises a reservoir R which contains a fluid substance F'.

The reservoir R is capable of releasing a portion, notably in the form of drops, of the fluid substance F' intended for an electrode matrix M' consisting of electrodes E'. The fluid substance F' is separated from the electrode matrix M' by a dielectric $D'_1$.

The reservoir R can also recover a portion, in particular in the form of drops, of the fluid substance F' originating from the electrode matrix M'.

The drops of the fluid substance F' are moved from the reservoir R to the electrode matrix M' or vice versa from the electrode matrix M' to the reservoir R by electro-wetting along a channel C of electrodes. The channel C of electrodes links the reservoir R to the electrode matrix M'.

A port R'F' passes through the electrode matrix M', the dielectric $D'_1$ and is in contact with at least one drop of the fluid substance F'.

The reservoir R makes it possible to release or recover drops of the fluid substance F' according to requirements and, more particularly, according to the desired changes in the properties of the antenna.

Thanks to the presence of the reservoir, it is very easy to cause the volume of the conductive fluid substance F' present on the electrode matrix M' and therefore the volume and the form of the radiating active element of the antenna, to vary In as much as it is possible to recover the drops that are not used to form the radiating active element of the antenna, the latter may not include any passive element.

Figure 5:
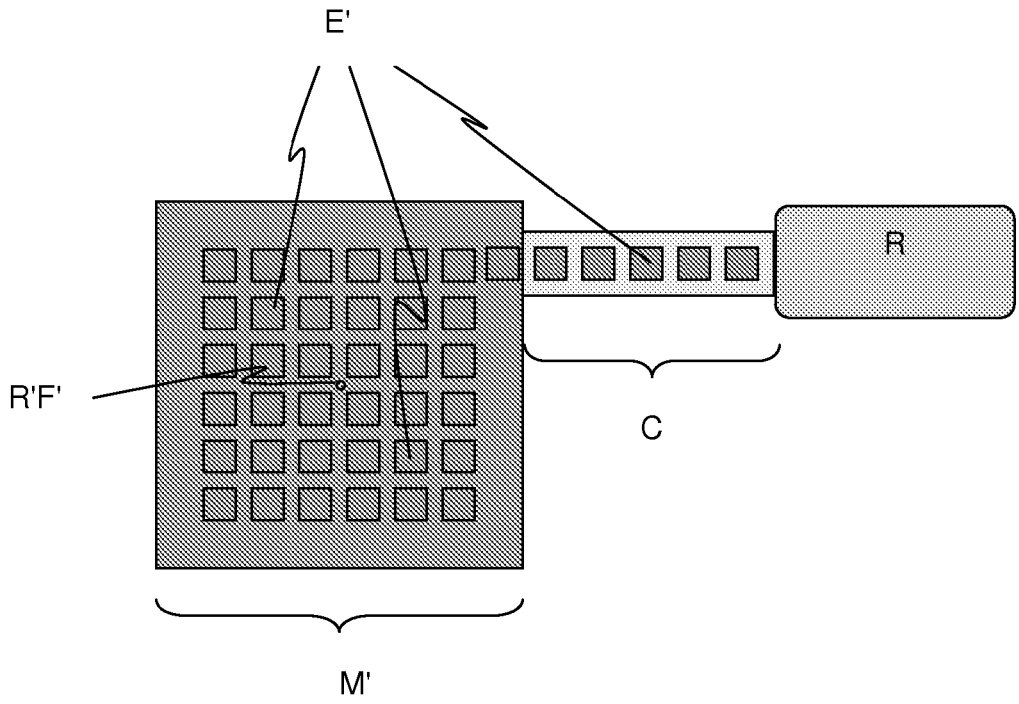
FIG. 5 is a top view of a schematic representation of the embodiment of FIG. 4.

FIG. 5 is a top view of a schematic representation of the invention according to the second embodiment described hereinabove.

Observing the reservoir R linked to the electrode matrix M' by the channel C of electrodes, the electrode matrix M' and the channel C of electrodes comprise a set of electrodes E'. A radiofrequency port R'F' appears at the surface of the electrode matrix M'.

Figure 6:
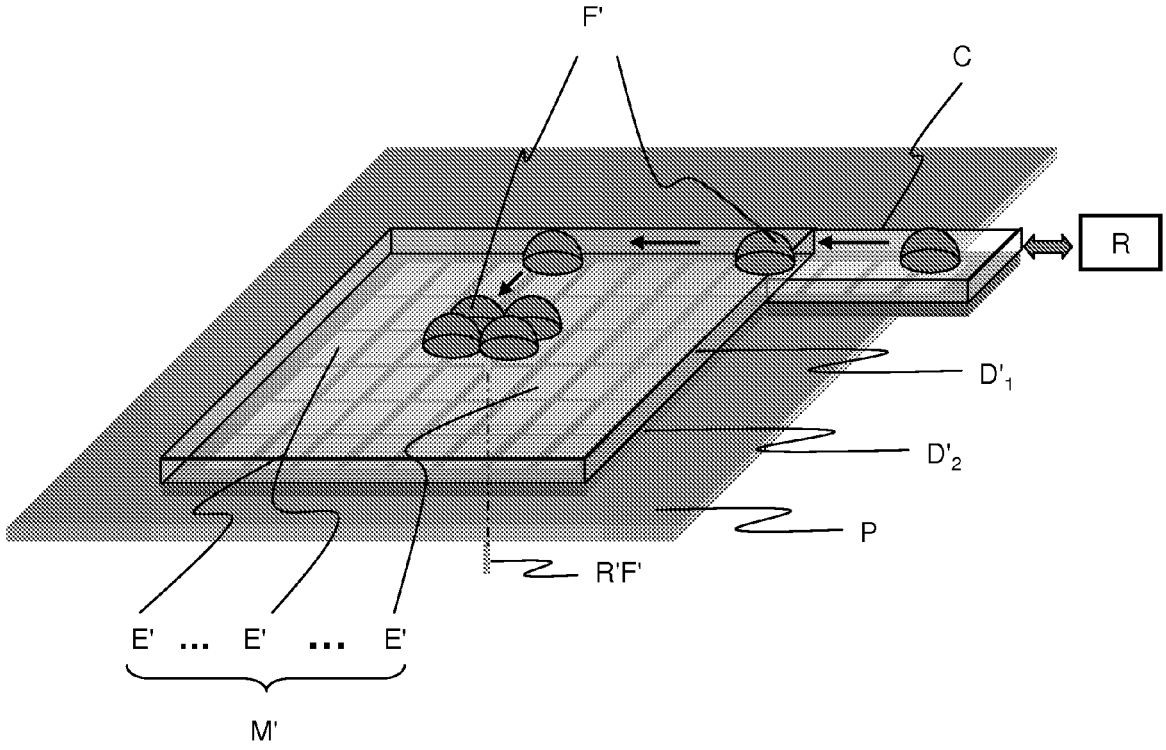
FIG. 6 represents a perspective view of a variant of an antenna according to the invention.

FIG. 6 represents a perspective view of a variant of an antenna according to the invention.

This variant is illustrated for the second embodiment of the invention, but also applies to the first embodiment of the invention.

According to this variant, the antenna also comprises a ground plane P.

The ground plane P is a conductive plane situated under the electrode matrix M'.

The electrode matrix M' is electrically insulated from the ground plane P by a second substrate or dielectric $D'_2$. The fluid substance F' is separated from the electrode matrix M' by the dielectric $D'_1$.

The port R'F' passes through the ground plane P, the dielectric $D'_2$, the electrode matrix M', the dielectric $D'_1$ before being in contact with a drop of the fluid substance F'.

FIG. 6 also shows the reservoir R and the channel C of electrodes according to the chosen method of illustrating this variant of the invention.

The ground plane makes it possible to obtain, for example, a patch antenna or a PIFA (standing for Planar Inverted FAntenna) type antenna.

Figure 7:
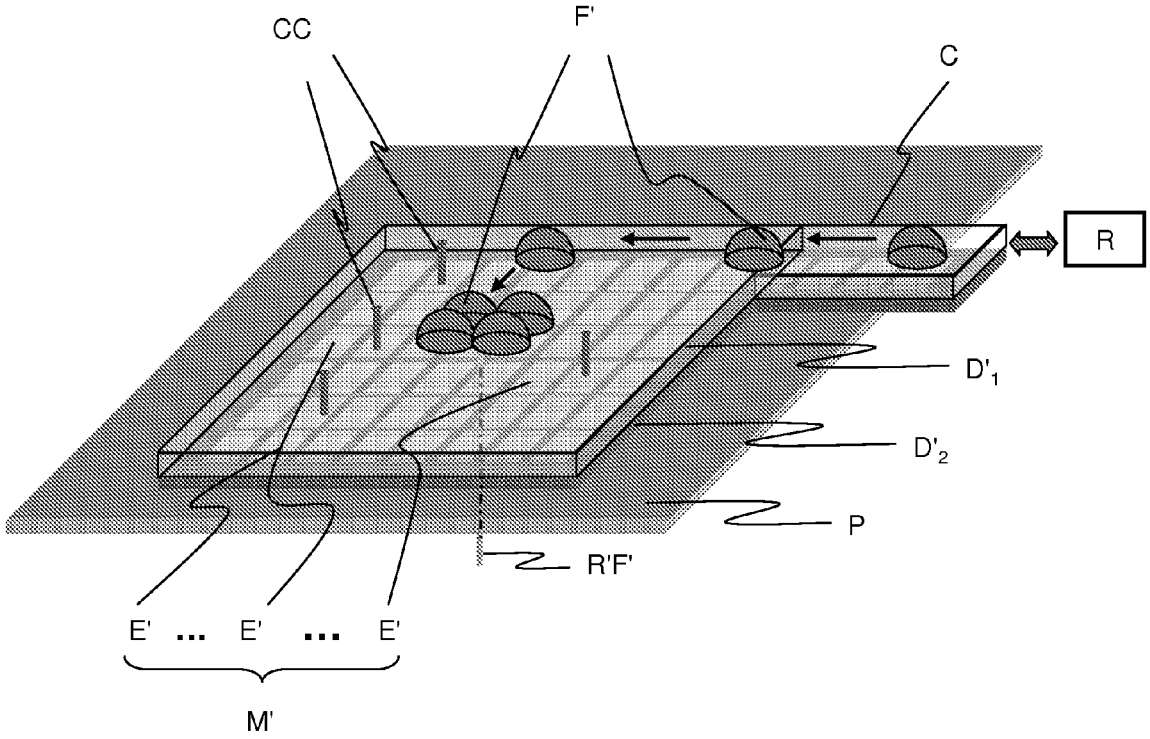
FIG. 7 represents a variant of an antenna based on the illustration of FIG. 6.

FIG. 7 represents another variant of an antenna according to the invention based on the variant described previously.

According to this other variant, the antenna comprises short-circuit elements CC.

These short-circuit elements CC are elements that conduct electricity which are connected to the ground plane P and pass through the dielectrics $D'_1$ and $D'_2$ so as to be in contact with the fluid substance F'.

In a preferred embodiment, the short-circuit elements CC are not in contact with the electrodes E' of the electrode matrix M'.

FIG. 7 also shows the reservoir R and the channel C of electrodes according to the chosen method of illustrating this variant of the invention.

In the case where the conductive fluid substance F' is both in contact with the port R'F' and one of the short-circuit elements CC, it is possible to obtain, for example, a PIFA-type antenna, the properties of which differ from a Patch-type antenna.

The number and the positioning of the short-circuit elements CC can be variable. According to a variant, at least one of these short-circuit elements CC is linked to an electrical dipole (impedance, switch, voltage-variable capacitor, etc.), which makes it possible to modify the properties of the antenna.

Figure 8:
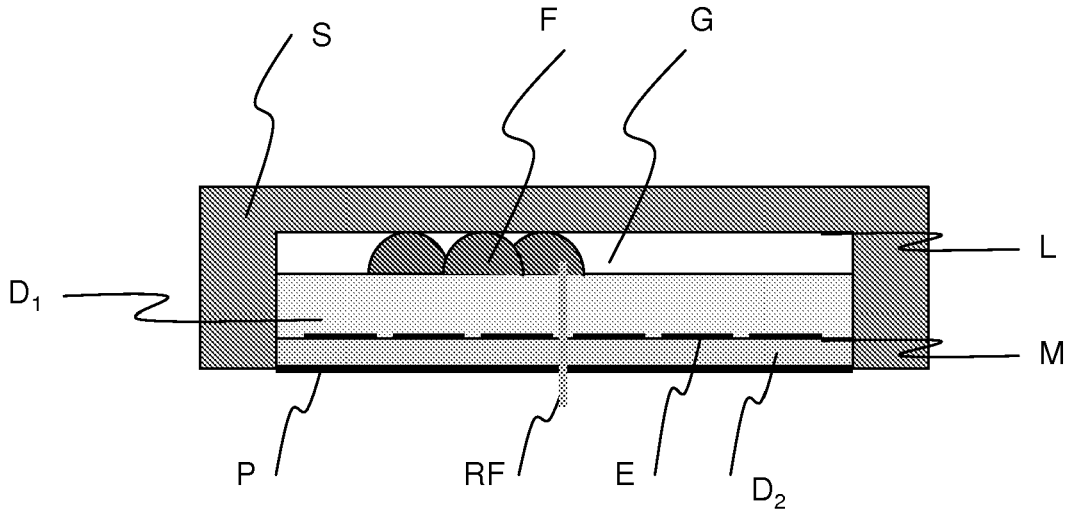
FIG. 8 represents a cross-sectional view of the antenna illustrated in the encapsulated FIG. 6.

FIG. 8 represents a cross-sectional view of the antenna according to one of the preceding encapsulated variants.

This variant is illustrated for the first embodiment of the invention but also applies to the second embodiment of the invention.

In order to be able to incorporate it in a device, the antenna according to the invention is enclosed in a capsule S.

The different component elements of the antenna, such as, for example, the ground plane P, the radiofrequency port RF, the electrode matrix M, the dielectrics $D_1$ and $D_2$ and the fluid substance F are enclosed in a capsule P consisting of a rigid or semi-rigid material. One of the planes L of the capsule P is parallel to the surface of the electrode matrix M and in contact with the drops of the fluid substance F.

The space G not occupied by the fluid substance F can be made up of air, a gas or even another non-conductive fluid substance.

The invention also relates to a radiocommunication terminal or any communicating object capable of receiving an antenna according to the invention.

The invention also relates to a method of manufacturing a reconfigurable electromagnetic antenna comprising a radiating element consisting of a fluid substance (F, F') that conducts electricity, the volume of the fluid substance (F, F') being variable. This method comprises a step for insertion of an electrode matrix (M, M') over which the fluid substance (F, F') is moved by electro-wetting.

The invention claimed is:

1. A reconfigurable electromagnetic antenna comprising a radiating element comprised of a fluid substance that conducts electricity, the volume of the fluid substance being variable, and a matrix of electrodes on which the fluid substance moves by electro-wetting.

2. An antenna according to claim 1, wherein the fluid substance takes the form of at least one drop.

3. An antenna according to claim 1, further comprising a reservoir containing the fluid substance and is capable of releasing or recovering a portion of the fluid substance.

4. An antenna according to claim 3, wherein a portion of the fluid substance is moved from the reservoir to the electrode matrix or vice versa by electro-wetting along a channel of electrodes.

5. An antenna according to claim 1, further comprising a dielectric which electrically insulates the electrodes of the electrode matrix and the fluid substance.

6. An antenna according to claim 1, further comprising a radiofrequency port in contact with the fluid substance.

7. An antenna according to claim 6, wherein the radiofrequency port is a differential port.

8. An antenna according to claim 1, further comprising a ground plane.

9. An antenna according to claim 8, further comprising at least one short-circuit element linking the ground plane to the fluid substance.

10. An antenna according to claim 1, comprising a capsule enclosing the different component elements of the antenna.

11. A radiocommunication terminal comprising an antenna according to claim 1.

12. A method of manufacturing a reconfigurable electromagnetic antenna comprising a radiating element consisting of a fluid substance that conducts electricity, the volume of the fluid substance being variable, said method comprising a step for inserting an electrode matrix on which the fluid substance is moved by electro-wetting.

* * * * *